United States Patent [19]

Patros et al.

[11] Patent Number: 4,877,131

[45] Date of Patent: Oct. 31, 1989

[54] FIREARM RECOVERY BAG

[76] Inventors: Spiro Patros, 13034 S. Buffalo, Chicago, Ill. 60633; Dominic C. Vimarco, 2929 W. 102nd Pl., Chicago, Ill. 60642

[21] Appl. No.: 187,742

[22] Filed: Apr. 29, 1988

[51] Int. Cl.[4] ..... B65D 85/00; F41C 27/00

[52] U.S. Cl. ..... 206/317; 224/911; 224/913

[58] Field of Search ..... 150/52 R, 52 H, 154; 206/317; 224/911, 913; 2/2.5; 428/911

[56] References Cited

U.S. PATENT DOCUMENTS

| | | | |
|---|---|---|---|
| 944,355 | 12/1909 | Beasley | 224/911 X |
| 2,524,931 | 10/1950 | Schoellkopf, Jr. et al. | 150/52 R X |
| 2,706,508 | 4/1955 | Kaplan | 150/52 R |
| 3,582,988 | 6/1971 | Armellino | 2/2.5 |
| 3,743,569 | 7/1973 | Wilkins et al. | 2/2.5 X |
| 3,971,072 | 7/1976 | Armellino | 2/2.5 |
| 3,988,780 | 11/1976 | Armellino | 2/2.5 |
| 4,186,648 | 2/1980 | Clausen et al. | 2/2.5 X |
| 4,190,183 | 2/1980 | Yates | 224/911 X |
| 4,475,247 | 10/1984 | Lee | 2/2.5 |
| 4,522,871 | 6/1985 | Armellino, Jr. et al. | 2/2.5 X |
| 4,530,178 | 7/1985 | Rauscher | 150/52 R X |
| 4,613,535 | 9/1986 | Harpell et al. | 2/2.5 X |
| 4,633,756 | 1/1987 | Rudoi | 2/2.5 X |

FOREIGN PATENT DOCUMENTS

| | | | |
|---|---|---|---|
| 208499 | 1/1987 | European Pat. Off. | 428/911 |
| 1581760 | 9/1969 | France | 2/2.5 |
| 18657 | of 1907 | United Kingdom | 224/913 |
| 2156272 | 10/1985 | United Kingdom | 428/911 |

OTHER PUBLICATIONS

American Body Armor & Equipment, Inc., 47 page brochure.

*Primary Examiner*—Sue A. Weaver

*Attorney, Agent, or Firm*—Fitch, Even, Tabin & Flannery

[57] ABSTRACT

A pressure vessel in the form of a flexible bag contains a firearm and a shot discharged therefrom, as well as a gas blast associated with the discharge of the shot. The bag includes a body of flexible ballistic material made of several plies of a ballistic cloth, and includes sidewalls and a bottom portion opposite an opening in which the handgun is inserted within the apparatus. A cover, also of flexible ballistic material, encloses the open end so as to completely enclose the firearm, and any shot and gas blast discharged therefrom. The cover is attached to the body by releasable fasteners which are openable to relieve internal gas pressure generated within the apparatus after the shot contained within the bag has been stopped. A stop member is located in the bottom portion of the bag, opposite the opening, and the apparatus includes an arrangement for orienting the barrel of the firearm so that its muzzle is placed adjacent the stop member. The stop member is made of a material which is hard enough to absorb the impact of a discharged shot, to transfer that impact to the flexible ballistic material, and to blunt the nose of a pointed bullet-type shot. Energy-absorbing material may be located adjacent the stop member to assist in dissipating the energy of a discharged shot.

20 Claims, 2 Drawing Sheets

FIREARM RECOVERY BAG

BACKGROUND OF THE INVENTION

1. Background of the Invention

The present invention pertains to containers for transporting loaded firearms and in particular, to energy-absorbing containers for the safe containment of shot discharged from the firearm, such as bullets or shotgun pellets, as well as the gas blast associated with their firing from a loaded cartridge.

2. Brief Description of the Prior Art

There has been a long-felt need among many law enforcement agencies to develop procedures for the safe recovery of a firearm that may be seized by a law enforcement officer in the course of his official duties. There is a great variety of firearms in use today, and increasing attention has been paid to the fact that a law enforcement officer may encounter any one of these weapons on a given day. The number and variety of firearms is so great that even with the usual training, a law enforcement officer may not be familiar with a particular firearm he is called upon to recover from a suspect.

In an emergency situation, the primary objective of the law enforcement officer is to gain control of the firearm weapon to prevent its discharge while in the possession of a suspect. After the emergency situation is under control, the law enforcement officer frequently conducts a preliminary investigation with bystanders and other potential witnesses. It is of utmost importance in such situations, for example, that accidental discharge of the firearm be prevented. In addition to the lack of familiarity with an uncommon firearm weapon, there is always the possibility that even a common weapon has been modified in a nonobvious way which tends to increase the likelihood of its accidental discharge. For example, a firearm may be modified to have a "hair trigger", requiring only a very light pressure on the trigger to initiate discharge of the firearm weapon. It has been observed that such modifications may cause the weapon to become discharged when it is bumped or dropped.

SUMMARY OF THE INVENTION

It is an object of the present invention to provide a protective device for totally enclosing a firearm so as to contain any discharge thereof in a safe manner, thereby protecting even those located immediately adjacent the device.

Another object of the present invention is to provide a device of the above-described type in the form of a bag made from ballistic material, having superior shot-stopping characteristics and which is lightweight and easily transported.

Yet another object of the present invention is to provide a bag of the above-described type having a stop member therewithin for absorbing the kinetic energy of a shot discharged from a firearm within the bag and/or deflecting the shot away from unreinforced portions of the bag.

Still another object of the present invention is to provide a bag of the above-described type having a cover releasably attached to the bag, which is automatically openable by a gas blast accompanying the discharge of a firearm within the bag, thereby preventing the bag from bursting.

These and other objects of the present invention which will become apparent from studying the appended description and drawings, are provided in a containment apparatus, such as a bag, for the safe recovery and transport of a firearm having a barrel and loaded with a cartridge having a shot and an explosive for projecting the shot through the barrel of the firearm in a preselected direction. The body of the bag is made from flexible ballistic material and forms an enclosure defining an opening through which the firearm is inserted into the bag. The body has a pair of sidewalls and a bottom portion generally opposite the opening. A cover of flexible ballistic material overlies substantially the entire body opening so as to completely enclose the firearm and any discharged shot, the cover having a free end overlying the enclosure. A releasable fastener, securing the cover free end to the body, can be opened to relieve gas pressure generated within the bag by the explosive, after the shot contained within the bag has been stopped by the body and/or cover. A stop member is provided within the bag adjacent the bottom portion thereof for partially dissipating the kinetic energy of the shot and/or deflecting the shot away from the bottom portion of the bag.

The containment apparatus to which the present invention is directed is intended for use with the directed discharge of a firearm as opposed to the nondirectional shrapnel and gas blast of a bomb. For purposes of describing the present invention, the term "bomb" as used herein refers to an explosive, incendiary or chemical-filled containment which is usually fragmentable, so that any shrapnel from the bomb, including the container fragments and any particles disposed within the container, are outwardly directed under the force of the explosion, in many directions, and oftentimes in all radial directions. In contrast thereto, the present invention is directed to firearms, including weapons from which a shot is fired in a specified direction by the force of an explosion and which are small enough to be carried. Examples of firearms include rifles, machine guns and the like hand-carried automatic weapons.

As opposed to a bomb which discharges multiple fragments and blast gases in different directions, a firearm includes a barrel for directing the shot and gas blast in a preselected direction. The shot discharged from the firearm may comprise either a single solid projectile, such as a conventional lead bullet, a burst of automatic arms fire, or may comprise a shotgun charge, which conventionally includes a plurality of small metallic pellets disposed within a common casing, all discharged by the same explosion.

While a shotgun and a bomb both discharge multiple pieces, usually of metal, a shotgun shot is confined to a single preselected direction, whereas the shrapnel of a bomb, including the bomb casing and any pellets or the like disposed within the bomb container are directed or radiated in all outward directions. For example, the shrapnel of a bomb is typically omni-directionally radiated, and the pattern of shrapnel discharged from the bomb is usually more or less evenly distributed in all outwardly radiating directions or spherical angles.

For bombs of any significant size, an enclosure for the adequate containment of their shrapnel requires a relatively heavy containment apparatus, too heavy to be lifted by one person. In contrast, a firearm recovery bag according to the present invention is relatively lightweight and portable, and can be carried, for example, by a law enforcement officer in the front seat or in the trunk of his vehicle, to the scene where a firearm has been recovered.

The firearm recovery bag to which the present invention is directed has reinforcement for a shot which is discharged in a specific direction. The firearm from which the shot is fired has a carefully controlled orientation within the bag. Thus, the firearm recovery bag according to the present invention can be made portable and relatively lightweight, while safely containing the significant explosive forces of even high-power weapons because of the controlled directionality of the shot discharged. Thus, the firearm recovery bag according to the present invention is a directional device, as opposed to bomb containment apparatus which, for reasons emphasized above, must be nondirectional (i.e., omni-directional) in its containment.

Two alternative embodiments of a firearm recovery bag according to the present invention are provided, one suitable for use in recovering a rifle type of firearm, the other suitable for use in recovering a pistol-type firearm. These firearm recovery bags are similar in construction. For example, both have a flexible bag-like body, the opening of which is enclosed by a releasable cover member. Both bags safely contain not only the firearm weapon inserted therein, but also any shot and associated gas blast which may be discharged from the firearm.

Because of the known directionality of the shot discharged from the firearm, the recovery bag according to the present invention may be reinforced over selected portions without requiring additional heavy massive reinforcement throughout the remainder of the enclosure apparatus. As will be explained in greater detail, both firearm recovery bags can either be dimensioned for a relatively snug fit of a particular firearm having known dimensions, or may have other means for containing the firearm in a preselected direction, thus ensuring that the more massive reinforcing members contained within the firearm recovery bag are optimally utilized. When constructed according to principles of the present invention, a firearm recovery bag can safely contain the shot from a wide variety of firearms and firearm rounds or cartridges (including automatic weapons fire) and is safe for use even with a variety of firearms loaded with many types of high-power rounds. For example, a firearm weapon of a given caliber may be employed to discharge not only regular cartridges but also cartridges having a higher explosive force, i.e., so-called "magnum" cartridges. Due to the ability of the recovery bag to safely contain a wide range of firearm discharges, a law enforcement officer can direct his attention to other matters, being assured that an unfamiliar weapon recovered from an uncontrolled environment will be safely contained during transport to a trained firearms expert.

BRIEF DESCRIPTION OF THE DRAWINGS

In the drawings, wherein like elements are referenced alike.

DETAILED DESCRIPTION OF THE PREFERRED EMBODIMENTS

Figures 1, 2, 3, 4, 6, 11:
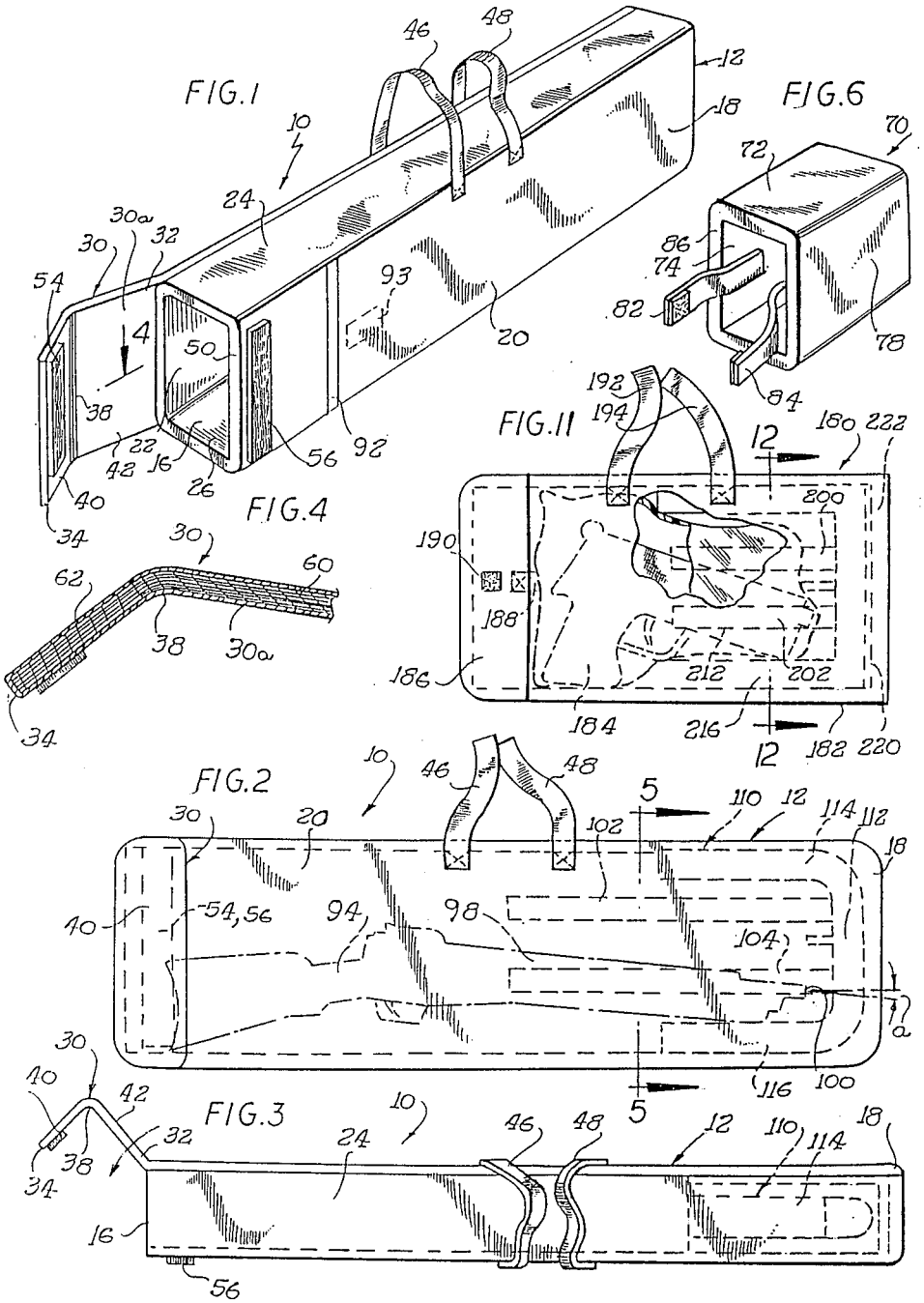
FIG. 1 is a perspective view of one embodiment of a firearm recovery bag illustrating features according to the present invention.
FIG. 2 is a plan view of the firearm recovery bag of FIG. 1.
FIG. 3 is a side elevational view of the firearm recovery bag of FIGS. 1 and 2.
FIG. 4 is a fragmentary cross-sectional view taken along the line 4—4 of FIG. 1.
FIG. 6 is a perspective view of a cover for the bag of FIG. 1.
FIG. 11 is a plan view of an alternative embodiment of the firearm recovery bag according to the present invention.

Referring now to FIGS. 1–5, a first embodiment of a firearm recovery bag illustrating aspects of the present invention is generally indicated at 10. As illustrated in FIG. 2, bag 10 is preferably dimensioned to receive a rifle type of firearm, or a weapon of the type commonly referred to as a "machine gun." The bag 10 includes a body 12 which is constructed of a suitable ballistic material, such as that described in U.S. Pat. No. 4,522,871. According to one aspect of the present invention, the ballistic material is typically formed of multiple overlying layers or plies of a ballistic fabric or cloth such as that commonly available under the trademark Kevlar. The body 12 is generally flexible and can be easily flattened or squeezed, by hand.

According to one aspect of the present invention, body 12 is formed to have a firearm-receiving opening 16 and a bottom portion 18, generally opposite the opening. Body 12 is preferably tubular in configuration, having opposed front and rear walls 20, 22 and a pair of opposed sidewalls 24, 26. Together, the walls 20, 26 form a hollow tubular body having a first end enclosed by a bottom portion 18, and a second open end defining the opening 16.

A closure or cover generally indicated at 30 has a first end 32 adjacent the rear wall 22 of the body, and a second, free end 34. Cover 30 preferably is formed of the same flexible construction as the body 12. A fold line 38 intermediate the two ends 32, 34 divides the cover into first and second portions 40, 42. Carrying straps 46, 48 are attached at their free ends to the front and rear walls 20, 22 by stitching or other suitable securement.

The first end 32 of cover 30 is hingedly connected to rear wall 22 so as to be foldable thereabout, allowing the cover portion 42 to close substantially the entire opening 16. If desired, short sidewalls can depend from portion 42 so as to overlie the sidewalls of body 12 when the cover is closed. When thus employed, the cover sidewalls form a continuous three-sided skirt with free end portion 40. The inner surface of cover portion 42 preferably engages the ring-like end surface 50 at the open end of body 12 (see FIG. 1). With bending about fold line free end 38, the remaining portion 40 of cover 30 overlies the free end of the front wall 20, as indicated in FIG. 2. Releasable fasteners 54, 56 are provided on cover portion 40 and front wall 20 to provide a releasable securement of the cover about the open end of body 12, to allow access into the interior of body 12 and to provide pressure relief. It has been found that releasable cover fasteners of the above-described type may be constructed to maintain attachment to the bag body so as to enclose its open end, even when a cover is impacted by a shot fired from the firearm, the cover cooperating with the body to completely stop a shot's path of directed travel before a gas blast associated with the discharge of the firearm builds an internal pressure wave within the bag, the cover attachment becoming released in response to the gas blast.

Figure 5:
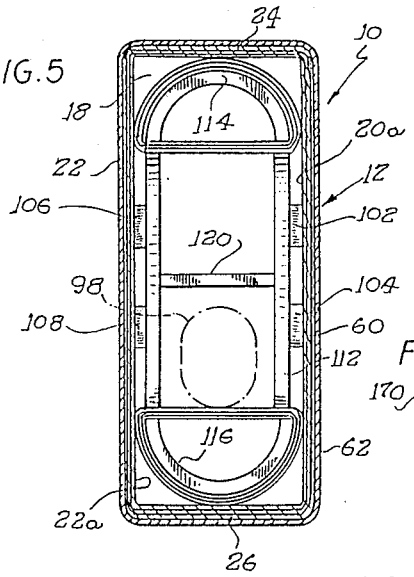
FIG. 5 is a cross-sectional view taken along the line 5—5 of FIG. 2.

Referring to the cross-sectional views of FIGS. 4 and 5, body 12 and cover 30 are, as indicated above, preferably formed of multiple plies 60 of ballistic cloth. The ballistic panels or walls forming the body and cover are encased in an outer fabric cover 62 which, as indicated in FIG. 4, extends around the free end 34 of cover 30 so as to also protect the inside face 30*a* thereof, visible in FIG. 1. The plies of ballistic cloth may be assembled using conventional techniques, such as those disclosed in U.S. Pat. Nos. 3,988,780, 3,971,072 and 3,582,988. Accordingly, the front, rear and sidewalls may not have sharp divisions as where one panel of ballistic material is butted against an adjacent panel. Rather, the panels may be formed by interleaving the plies of ballistic cloth in a staggered relationship so as to avoid points of weakness at the "corners" where one wall meets another, for example, where the front wall 20 meets the sidewall 24. In this manner, the tubular body can be formed without corners.

The cover 30 of the preferred embodiment is formed as an integral extension of body 12 and at least the rear wall 22 thereof. The integral construction is preferred due to economies of fabrication and because the cover member is attached to the body 12, and is not likely to become lost or misplaced. If desired, an alternative cover 70, illustrated in FIG. 6, can be used. The cover 70 includes a tubular body 72 having an open end with an opening 74 and an opposed, closed end 78. The opening 74 is dimensioned to telescopically receive the open end of body 12, such that the tubular body 72 overlies the walls 20, 22, 24, 26 of the body of the firearm bag. In this alternative embodiment of the cover, the closed end 78 includes an end wall (not visible in FIG. 6) having the approximate dimensions of the aforedescribed cover portion 42. Releasable securement fasteners or straps 82, 84 are attached to the inside surface 86 of the tubular body 72. The straps 82, 84 may comprise, for example, the hook-and-loop fastener material sold under the trademark "Velcro." The active surfaces of the releasable fastener material are located on the inside of each strap 82, 84, so as to oppose each other.

Referring to FIG. 1, a colored band or other indicia 92 is provided on the outer surface of body 12 to indicate a complete telescopic insertion of the open end of body 12 within the cover 70, thus assuring the desirable full mating of the cover to the body of the firearm recovery bag. Mating hook-and-loop fastener material 93 is provided on the front and rear walls 20, 22 to provide securement with the fastener straps 82, 84. If desired, the mating overlying alignment of straps 82, 84 with the releasable fastener material 93 can be relied upon to indicate the proper, full or complete engagement between cover 70 and body 12, and indicia 92 can therefore be omitted. The advantages of ensuring the complete telescopic insertion of the free end of body 12 within cover 70 will become apparent in the discussion herein pertaining to the pressure release aspects of bag 10.

In use, the bag 10 is carried to a recovery site, and the opening 16 of the tubular body is uncovered to allow insertion of a firearm 94 (see FIG. 2) therein. Thereafter, the cover (either 30 or 70) is applied to the open end of the bag so as to enclose the opening 16. The cover is releasably secured to one or more walls of the body 12, using the hook-and-loop releasable fasteners (56 or 93, for example). The firearm 94 is thereupon completely enclosed within bag 10. According to one important aspect of the present invention, the bag 10 functions as a pressure vessel containing pressure generated within its interior up discharge of the firearm 94. Such pressure is, in general terms, generated by the impulse of the shot ("bullet") and by the pressure wave of the gaseous discharge and combustion products of the explosive charge used to propel the shot along the barrel 98 of the firearm, so as to exit its muzzle 100.

According to one important aspect of the present invention, the recovery bag is intended for use with firearms having a directed discharge; i.e., firearms having a discharge of shot, combustion products and the like, which travels in a known, controlled direction. Knowing the orientation of the barrel 98 of the firearm, for example, the direction of the discharge from its muzzle 100 is also determined, and certain components of bag 10 are positioned relative to the barrel, so as to provide directionally-maximized stopping ability, carefully oriented to the directional discharge from the firearm.

According to one aspect of the present invention, the directional orientation of bag 10 is provided by dimensioning the interior of bag 10 for a relatively close or snug fit of the firearm inserted therewithin, so as to prevent substantial shifting of the firearm barrel therewithin. As indicated in FIG. 2, the interior cavity of the bag can be sized to provide relatively close control of the direction of barrel 98. The snug fit of the firearm 94 within bag 10 can be provided, for example, by closely matching the length of the interior cavity of the bag to the length of the firearm in the manner shown in FIG. 2. Due to their traditional construction, most firearms, whether of the rifle or pistol variety, have elongated cross-sectional configurations and thus may be "laid flat" in one of two orientations. The firearm 94 can be inserted in bag 10 in one of two orientations, each obtainable by rotating the firearm 180° about its longitudinal axis (i.e., the axis of the barrel). The snug fit of the firearm within the ballistic bag 10 is readily attained by providing the bag 10 with a tubular body 12 of elongated cross-section, shown most clearly in FIG. 5.

However, it is sometimes desirable to provide a firearm recovery bag which can be used with a wide variety of firearm weapons covering a range of lengths and cross-sectional dimensions. Accordingly, the firearm recovery bag 10 is provided with mating strip of releasable fastener material, such as the flexible magnetic strips or the hook-and-loop fastener material sold under the trademark "Velcro." The releasable strips are indicated in phantom in FIG. 2 by the reference numerals 102, 104. Referring to the cross-sectional view of FIG. 5, strips 102, 104 are secured to the interior surface 20*a* of front wall 20 and face toward the opposed rear wall 22. Mating strip fasteners 106, 108 are secured to the inside surface 22*a* of rear wall 22. Thus, referring to FIG. 2, after insertion of firearm 94, the front and rear walls 102, 104 of the bag can be squeezed together or compressed so as to mate the strips 102, 106 of releasable fastener material, thereby confining the movement of barrel 98.

If care was taken to always insert the firearm in the manner indicated in FIG. 2, the second set of releasable strips 104, 108 could be eliminated. However, to remove this restriction and so as to accommodate firearms inserted in either orientation, the second set of releasable strips is provided. For example, if the firearm 94 were inserted in bag 10 so that the muzzle was positioned adjacent the sidewall 24 rather than the sidewall 22, as illustrated in FIG. 2, the releasable strips 104, 108 would be mated to confine movement of the barrel 98.

It is generally preferred that one or at most a few different models or sizes of the firearm recovery bag be maintained by a law enforcement office, with each model of a firearm recovery bag being suitable for use with a fairly wide variety of firearms which may be recovered in the course of the office's duties. In addition to variations in size, firearms vary widely in the amount of firepower or energy of the shot discharged therefrom, and in the volume of combustion products generated when a cartridge is discharged. There are practical limits on the energy of a shot which can be safely contained by a multi-ply panel of flexible ballistic material. In theory, the ballistic material can be formed with additional plies for greater stopping power, but there is a practical limit on the number of additional plies which can be added to the panel construction, since the ballistic bag, if so constructed, would be prohibitively expensive and too bulky and heavy for one person to carry.

One alternative to the present invention is to provide a chest of rigid material having wall thickness and mass so as to require two or more individuals to transport the chest from one location to another. However, it is an object of the present invention to provide a firearm recovery bag which is readily transportable by a single person without requiring assistance from others. In order to be lightweight, the recovery bag is provided with one or more discrete stop members placed only at a carefully controlled orientation relative to the directed discharge of the firearm. Referring to FIG. 2, the barrel of the firearm is carefully oriented such that the discharge therefrom is pointed generally toward the bottom portion 18 of the bag. Thus, the bottom portion of the bag is first struck by a shot discharged from the firearm and receives an impact of maximal energy, compared to the impact sustained by the sidewalls or cover as the shot ricochets within the bag 10. Accordingly, the stopping power of the sidewalls and cover need not be as great as that of the bottom portion, as long as the directionality or orientation of the discharged shot is carefully controlled using one or more of the features described above for that purpose.

While some firearms have a sufficiently low power rating so as to be safely contained within a "nonreinforced" recovery bag having only flexible ballistic material in its bottom portion, they represent only a fraction of the type of firearms commonly recovered by law enforcement agencies. There is a risk that higher-powered firearms might also be inserted within the "nonreinforced" bag, especially if the bag is released for general, multipurpose use. A large caliber firearm with a "regular" cartridge or a smaller caliber firearm with a special high-powered cartridge might have sufficient energy to penetrate the bottom portion of the "nonreinforced" bag. In order to eliminate the risk of such occurrence, and to provide a lightweight firearm recovery bag suitable for containing a wide variety of firearms and cartridges, it is preferred that a stop member, such as the stop member 110 of FIG. 2, be provided in the bottom portion of the recovery bag.

Figure 7:
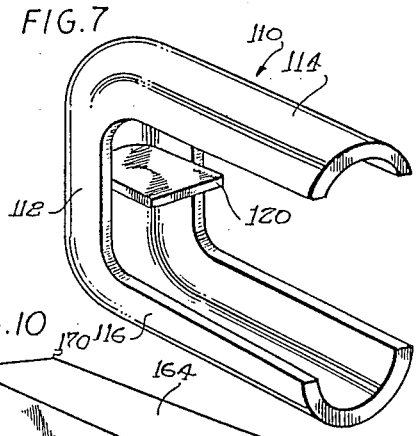
FIG. 7 is a perspective view of one embodiment of a stop member insertable within the above firearm recovery bag.

The stop member 110 has a generally U-shaped construction with an intermediate bight portion 112 disposed between a pair of legs 114, 116. The stop member 110 is shown in greater detail in the perspective view of FIG. 7, and as can be seen therein, the bight portion 112 and legs 114, 116 each have a concave surface facing the interior of bag 10. As indicated in FIGS. 2, 3 and 5, stop member 110 preferably forms a snug fit with the interior walls of body 12, and no other positioning means is needed to hold the stop member in secure orientation relative to the firearm 94. Upon impact from a discharged shot, stop member 110 will be seated more firmly in its desired position within box 10, and thus will not be displaced. As illustrated in FIG. 7, the bight portion and legs of stop member 110 are of relatively thin wall construction, having a uniform thickness. Accordingly, the outside surface of stop member 110, that contacting the walls of body 12, is generally convex. In addition to the convex outer surface of the stop member, the corners where the bight portion 112 is joined to the legs 114, 116 are rounded in order to reduce the outwardly-directed internal pressure stress imparted to the bottom portion 18 of bag 10 when the firearm is discharged. Stop member 110 further includes a medial divider 120 oriented generally perpendicular to the axis of bight portion 112, extending toward the interior of the bag 10.

Referring again to FIG. 2, bag 10 provides an angular offset between the barrel 98 of firearm 94 and a theoretical line extending perpendicular from the bight portion 12 toward cover 30. This angular offset, indicated by the letter a (see FIG. 2) is chosen to ensure that a shot deflected from stop member 110 is not directed toward the cover of the ballistic recovery bag. The stop member 110, and the means for positioning or orienting the firearm inserted within the bag are, according to one aspect of the present invention, configured to cooperate with each other to ensure that the shot discharged from the firearm will impact the stop member and the walls of the body 12 at least several times, before the shot impacts the cover. In the preferred embodiment, the U-shaped configuration of stop member 110, and its concave interior, together with the releasable fastener strips 102–108 for orienting the firearm, cooperate to ensure that the shot impacts the lower portion of the bag and the bag sidewalls several times before it is allowed to impact the cover.

It is possible, given a firearm of a particular barrel length and orientation within bag 10, that a shot discharged from the firearm, even though directed toward the bottom portion 18 upon its emergence from the firearm muzzle 100, may be turned around by following the round-cornered U-shaped configuration of stop member 110, so as to be directed toward the bag's cover. Accordingly, divider 120 is provided for this purpose, to prevent the stop member 110 from directing a shot toward the bag cover, since a shot will be deflected by the divider wall before being turned around by the U-shaped stop member. Since the stop member 110 receives the most energetic impact of a discharged shot, stop member 110 is preferably made of a suitably durable material such as steel or ceramic, strong enough to withstand the impact without shattering or disintegrating so as to maintain a shot-deflecting surface.

Further, it is preferred that stop member 110 be hard enough so as to deform the shot, thereby enlarging its leading end. Steel or ceramic materials are preferred for this purpose, also. Flexible ballistic material available today is typically made from woven fibers which can be separated if a sufficiently small radius point is applied to the woven fabric. According to one aspect of the present invention, the stop member 110 is hard enough so as to not only withstand the initial impact of the discharge shot, as well as subsequent impacts, but also to blunt the point nose of a bullet-type shot, for example, thereby reducing the ability of the shot to separate the weave of the ballistic fabric so as to penetrate layers of the flexible ballistic cloth forming the plies of the ballistic material comprising the wall sections of the body 12.

Most firearm weapons commonly in use today have sufficient firepower as to impart a very significant impact force to the stop member 110, especially upon an initial impact therewith. As mentioned above, it is important that the pressure on the plies of the ballistic material be reduced as much as possible by increasing the surface area over which the force is applied. The momentum of a shot is transferred at least in part to stop member 110, with the stop member in turn applying an internal pressure force to the bag body 12. Thus, quite unlike bulletproof vests and the like, the firearm recovery bag according to principles of the present invention, experiences a tension or internal pressure force. This force is unsupported by backing members, walls or the like located outside of the bag 10. It is important for the successful operation of the firearm recovery bag that the internal pressure applied to the ballistic material be reduced by application to as large an area as possible, especially upon an initial impact.

As will be appreciated by those skilled in the art, many firearm weapons currently in use today have sufficient firepower to cause their discharged shot to penetrate even the thickest practical flexible ballistic material. In order to provide a firearm recovery bag with significant stopping power for the widest variety of firearms which may be encountered, the stop member 110 plays a significant role in resolving the first impact of a discharged shot with the least amount of pressure imparted to the bottom portion of the ballistic material body and in dissipating as much energy of the discharge shot as is possible, before allowing the shot to be deflected toward the sidewalls of body 12. As mentioned above, it is preferred that the stop member 110 have a U-shaped configuration with rounded corners, so as to spread the impact force over as large an area of the bottom portion 18 as is possible. Further, it is also preferred that the U-shaped body of stop member 110 have an outer convex configuration in addition to having rounded corners, so as to increase the area of contact with the bottom portion 18 of the bag, to a further extent.

Figure 8:
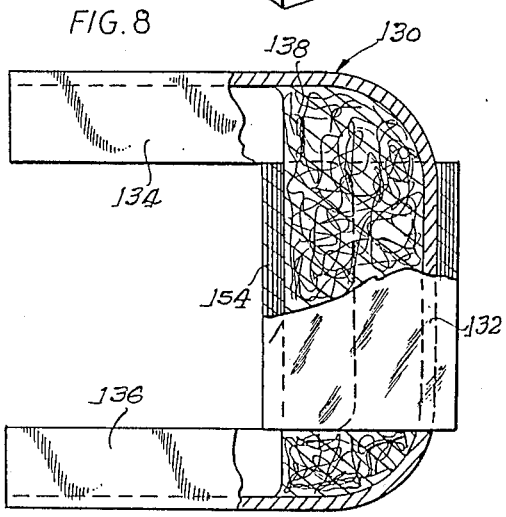
FIG. 8 is a plan view taken partially in cross-section of an alternative embodiment of a stop member according to the present invention.
Figure 9:
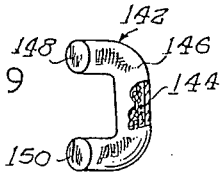
FIG. 9 is a perspective view of an energy-absorbing assembly insertable in a stop member.

Turning now to FIG. 8, a further energy absorption is provided in a stop member 130 which is substantially identical to the stop member 110 of FIG. 7, having a bight member 132 intermediate leg members 134, 136. A divider wall, such as the divider wall 120 of FIG. 7, has been omitted from stop member 130, but it could be added if desired. To further enhance the energy-absorbing ability of the stop member and to more efficiently disperse the energy of the discharged shot throughout the entire stop member, a monolithic mass of energy-absorbing material, indicated by the reference numeral 138, fills the bight portion 112, and optionally, part of the adjacent legs 134, 136. Material 138 can comprise, for example, epoxy material poured into the stop member 110 using the stop member 110 as as convenient mold for this purpose. Material 138 could also comprise Fiberglas-reinforced epoxy, a rubber (preferably a soft rubber), a plastic, or a fiber-reinforced plastic, for example. One preferred embodiment of the energy-absorbing material comprises lead or soft metal particles embedded in epoxy in a concentration sufficient to blunt the nose of a pointed bullet-type shot and to adhere to the nose of the shot, thereby increasing its surface area.

Figure 10:
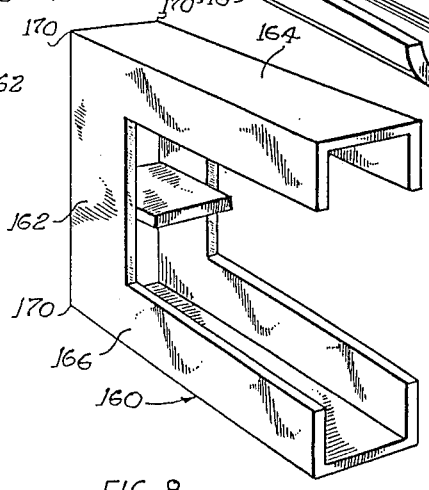
FIG. 10 is a perspective view of an alternative embodiment of a stop member according to the present invention.

Referring now to FIG. 10, the energy-absorbing material 138 of FIG. 8 can be replaced by an energy-absorbing assembly 142 comprising energy-absorbing material 144 disposed within an outer flexible cover 146, preferably made of flexible ballistic fabric, such as Kevlar or the like. The cover 146 has closed free ends 148, 150 to maintain the material 144 within the cover. The material 144 preferably comprises small beads, filings or discrete particles of a soft metal, which upon impact from a discharged shot, will absorb some of the energy of the shot. The soft metal particles are deformed and partially melted due to the force of friction. In addition, the metal particles, due to their small size, will become heated sufficiently so as to melt and adhere to the shot, thereby increasing its surface area. The assembly 142, which has handling characteristics somewhat resembling a small-scale elongated sand bag, can be formed to a U-shape nestable within the concave area of the bight portion and legs of the stop member 130. The stop member 130, as mentioned above, preferably has a configuration similar to that illustrated in FIG. 7. The concave configuration of the bight portion and legs 132, 134, 136 of the stop member form sidewalls which, in cross-section, extend over nearly one-half the outer periphery of the tubular assembly 142, thereby reducing the risk of its bursting upon impact with a discharged shot.

If desired, the energy-absorbing material 138 or the energy-absorbing assembly 142, can be covered by one or more layers of a flexible ballistic fabric wrapped about the bight and optionally the leg portions of the stop member. FIG. 8 illustrates several layers of flexible ballistic fabric wrapping 154. It is expected that, for most weapons, a discharged shot leaving the muzzle of the firearm, will penetrate the wrapping 154, so as to enter a hollow interior cavity, an energy-absorbing material or an energy-absorbing assembly located within the bight portion of the stop member. The wrapping 154 will dissipate some of the energy of the discharged shot but more importantly, will significantly slow the shot as it exits the wrapping 154, before entering the interior of the bag. It is expected, especially when the energy-absorbing material or an energy-absorbing assembly is employed in the stop member, that the wrapping 154 would be able to trap the shot within the bight portion of the stopping member.

In FIG. 10, an alternative embodiment of a stop member is generally indicated at 160. The stop member 160 includes a bight member 162 and intermediate leg portions 164, 166. In contrast to the stop member 110 of FIG. 7, the concave cross-section of the bight member and legs of stop member 160 has square corners which enhance the angular deflection of a discharged shot away from the opening of the recovery bag. An additional difference is found in the square corners 170 of the U-shaped configuration, located at the joinder of the bight portion with the legs. The square outside corners increase the control of the angular deflection of a discharged shot. The square outer corners might be objectionable in some applications due to the localized pressure applied to the bottom portion 18 of the body 12. If desired, however, the square cross-sectional shape of the bight portion and legs can be provided in a stop member having rounded outside corners where the bight portion and legs are joined, thus presenting a shadow profile similar to that of the stop member 110 of FIG. 7.

Figure 12:
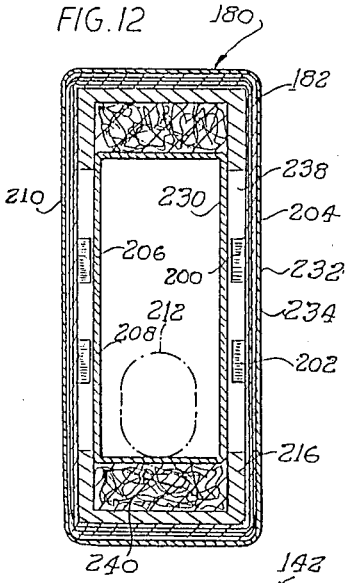
FIG. 12 is a cross-sectional view taken along the line 12—12 of FIG. 11.

Referring now to FIGS. 11 and 12, a firearm recovery bag 180 is illustrated having a body 182 constructed in a manner substantially identical to the body 12 described above, but having a smaller size, scaled for the snug fit with a pistol-type firearm 184 received therein. Body 182 is constructed of a flexible ballistic material comprised of multiple plies of a flexible ballistic fabric, with or without intermediate layers.

The firearm recovery bag 180 has a cover 186 of a construction similar to the cover 70 described above with reference to FIG. 6. Cover 186 is of a separate, telescoping slip-on type, having hook-and-loop type fastener straps 188 sewn or otherwise attached to an inside wall of the cover. Mating hook-and-loop fastener tab 190 is used to secure the outer exposed surface of the retaining strap 188 to ensure the retaining strap does not impede the telescopic reception of the open end of body 182 within cover 186. Bag 180 includes carrying straps 192, 194 attached to the major wall panels of body 182 by stitching or the like. The cover 186 and body 182 cooperate to define a substantially enclosed chamber in the same manner as that described above with reference to the larger size firearm recovery bag for rifles, machine guns and the like.

The firearm recovery bag 180 includes releasable fastening strips 200, 202 attached to the inside surface of a front wall 204 of bag 180. These strips mate with cooperating hook-and-loop fastener material strips 206, 208 attached to the opposing rear wall 210 of bag 180, to maintain the position of the firearm 184 relative to the bag 180 and the internal components thereof. For example, after the weapon 184 is inserted within bag 180, the front or rear walls are tamped or pressed together to mate to the releasable fastening strips 200, 206, thereby securing the barrel 212 of the firearm from lateral displacement or movement toward the upper end of body 182, that end adjacent the carrying handles 192, 194.

Inserted within bag 180 is a stop member 216 substantially identical to the stop member 160 of FIG. 10, except having a smaller size scaled to accommodate a pistol-type firearm. To alleviate the stress of pressure pulses against the bottom portion of body 182, especially upon initial impact with a discharged shot, a backing plate 220 of rigid material is provided. Upon initial impact of a discharged shot, the stop member 216 is driven with an impulsive force toward the bottom 222 of body 182 to help distribute the pressure force to the body 182 and to avoid piercing plies of the resilient ballistic fabric with the corners of the stop member. The backing plate 220 is inserted into the bottom portion of the body 182 and forms a relatively tight friction fit therewith. Preferably, the edges and corners of backing plate 220 are rounded, so as to avoid piercing the flexible ballistic material panels when the impulsive force of the discharged shot is transmitted thereto. If desired, a resilient material such as rubber, foam or a coiled or leaf spring arrangement, can be disposed between the bottom-most relatively flat surface of the central bight portion of stop member 216 and backing plate 220, to help absorb some of the kinetic energy of the discharged shot.

One feature present in the ballistic recovery bag 180, not present in the previously-described bag, is an optional liner 230 which completely overlies the interior of bag 182, except for its open end where the liner is secured to the bag by stitching or the like securement. Thus, the liner 230 has a construction and attachment resembling a trousers pocket. Liner 230 is preferably formed of a flexible ballistic fabric such as Kevlar or the like. At most, the liner has only a few overlapping plies, but preferably comprises a single ply of ballistic fabric or material. While the liner 230 is ineffective in stopping a discharged shot as it exits the barrel 212 of firearm 184, the energy of the discharged shot is quickly dissipated in the stop member, especially upon multiple impacts therewith, and the liner 230 quickly becomes effective in trapping the discharged shot between itself and the interior surfaces of body 182, thereby significantly reducing the probability that the shot will enter the cover 186. The liner 230 also plays a significant role in deflecting the discharged shot as it travels between impacts. The optional liner 230, when employed, obstructs use of the hook and loop fasteners 200, 202, 206, 208 affixed to the inside surfaces of bag 180. If desired, a similar arrangement of hook and loop fasteners may be applied to the inside surface of liner 230 to aid in orienting the firearm 212 in the desired direction.

FIG. 12 is a cross-sectional view taken through the bottom portion of the firearm recovery bag 180. An outer fabric cover 232 and the individual plies 234 of the flexible ballistic material comprising the wall panels of the bag body 182, are visible in the Figure. As shown in FIG. 12, the barrel 212 of the firearm rests against the inner liner 230 which forms an enclosed interior chamber 238 between the liner 230 and the inner surfaces of body 182. If desired, additional energy absorbing material 240 may fill all or a portion of the the chamber 238. As illustrated in FIG. 12, for example, the energy-absorbing material 240 fills the concave channels of legs of the stop member 216. If desired, the energy-absorbing material could also fill the bight portion of the stop member in the manner indicated above with respect to FIG. 8. The energy absorbing material 240 can comprise any of the materials or assemblies described above and may comprise, for example, cast epoxy, sand, flakes, filings, or particles of a soft metal, or virtually any pulverulent or granular material. In addition, the stop member may be totally or partially wrapped with one or more layers of a ballistic fabric.

As mentioned, the stop members are preferably made of a material which does not shatter or fragment upon impact, especially the initial impact of a shot discharged from a firearm which, according to one aspect of the present invention, will be at close, negligible range. The preferred materials for the stop members include metals, especially steel, and also ceramic of an appropriate type. It is especially preferred, in order to provide a firearm recovery bag suitable for use with a great number of commonly available weapons, that the stop member be capable of withstanding repeated, rapid-fire bursts of shot from a fully automatic weapon. When constructed according to the present invention, as described herein, the firearm recovery bags are suitable for safely containing such repeated, automatic weapons fire.

The ability of the firearm recovery bag to safely stop a discharged shot or a volley of automatic firearm shots, has been discussed. However, those skilled in the art are aware that a significant gas blast accompanies the shot discharge and that it is important to contain such gas blast or pressure shock wave, particularly when the weapon is at very close range, as is contemplated with the hand-carriable ballistic recovery bag according to the present invention. As mentioned above, the various ballistic recovery bags described herein are pressure-containment vessels, the pressure being applied not only from an internally discharged shot, but also by the gas blast accompanying that shot. It is expected that, generally speaking, the shot will typically be stopped or brought to rest before the pressure wave generated by the gas blast is fully developed within the enclosed interior of the firearm recovery bag. Thus, after stopping the shot, to provide adequate safety for personnel close to the recovery bag, the pressure wave of the gas blast must also be contained.

If desired, one or more pressure vents can be installed in the body of the firearm recovery bag, extending from the interior of the bag to a muffler device external to the bag and mounted preferably on an outer surface thereof. However, such arrangements may compromise the integrity of the shot-stopping ability of the recovery bag and are generally not preferred. According to some aspects of the present invention, the pressure wave of the gas blast generated within the recovery bag is dissipated by providing a controlled release of the pressure between the cover and the body, or the remaining portion of the firearm recovery bag. With a cover hingedly joined as an extension of the body, as illustrated in FIG. 1, for example, the gas blast, if strong enough, will cause the attachments 54, 56 of the cover to the body to become released, in the course of safely dissipating the gas blast energy. For a separate cover of FIG. 6, shown installed in FIG. 11, for example, one or more of the releasable fastener straps may become released, allowing the cover to become displaced from the open end of the body. If it is desired to ensure retention of the cover to the body, a longer safety strap can be provided attached between the cover and the body, having slack sufficient to allow the separation of the releasable fasteners, thus dissipating the gas blast energy, but having a length short enough to ensure adequate retention of the cover about the bag body.

If desired, any of the stop members described above can also be inserted in the open end of the bag, prior to enclosing that end with a cover. The U-shaped stop member configuration is especially suitable for this purpose in that it is self-aligning and adequately supported if snugly fit within the bag body, and also because the sealing of the open end against a discharged shot is improved.

As described above, entrance to the interior of the firearm recovery bag is provided by an end flap or telescoping cover mating with an end of the bag opposite the end in which the stop member is installed. However, it is also possible according to aspects of the present invention to provide an entrance opening on a side, front or rear wall adjacent the stop member. For example, the bag 10 illustrated in FIG. 1 can be modified to have the open end thereof sealed in a manner substantially identical to the bottom portion 18. A second stop member can also be provided at the newly formed closure wall opposite the bottom portion 18. Entrance to the bag 10 is provided by a closure flap on the side wall 24, for example, or the front wall 20. If the flap is provided in place of the side wall 24, the wall is preferably continuously hinged to the rear wall 22 and has a flap portion overlying the front wall 20. As before, the flap of the wall 24 has a continuous releasable fastener along the flap, joining the flap to the front wall 20.

As mentioned above, the bag 10 illustrated in FIG. 1 is particularly suitable for use with an elongated firearm weapon such as a rifle. With the modification wherein wall 24 is converted to a releasable flap, the firearm weapon can be inserted within bag 10 with a substantially reduced friction and with a motion substantially normal to the direction of trigger depression, thus enhancing the safety to nearby personnel during insertion of a firearm weapon within bag 10. If desired, however, the flap 24 can be replaced by a tray-like body portion substantially identical to the major body portion of bag 10, and having an elongated opening for telescopically receiving the body of bag 10, wherein the front and rear walls 20, 22 would be overlapped by side walls of the tray-like cover. Thus, this latter alternative is similar to the end cover 70 of FIG. 6, except that the side wall 24, rather than the open end portion, will be enclosed by the cap-like or tray-like cover.

If desired, the stop member inserted in one or both ends of the modified bag can be formed of two L-shaped pieces which, when mated, approximate the U-shaped configuration described in FIGS. 7, 8 and 10, for example. One L-shaped leg can be inserted in the bottom corner of the bag, and, after insertion of a firearm weapon within bag 10, a second opposed L-shaped member can be inserted above the first. It is preferred that legs of the L-shaped member overlap at the end wall to provide continuous protection.

Although various embodiments of a firearm recovery bag according to the present invention are illustrated as having generally square corners, it is preferred, as stated above, that the body walls forming the bag be flexible and in some embodiments, be compressible with hand pressure so as to releasably join two opposed surfaces of the wall together at their interior surfaces. Accordingly, the present invention also contemplates firearm recovery bags which do not have corners or which have well-rounded, barely noticeable corners. As an example of cornerless construction, the firearm recovery bag can be constructed of a generally cylindrical tube-like flexible bag. Other configurations are, of course, possible.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A containment apparatus for the safe recovery and transport of a firearm having a barrel and loaded with a cartridge, the cartridge loaded with a shot and an explosive for projecting the shot through the barrel of the firearm in a preselected direction, the apparatus comprising:

a body of flexible ballistic material forming an enclosure defining an opening through which the firearm is inserted for entry into the body, the body having at least a pair of sidewalls and a bottom portion generally opposite the opening;

a cover of flexible ballistic material overlying substantially the entire body opening so as to cooperate with the body to completely enclose the firearm and any shot discharge therefrom, the cover having a free end overlying the enclosure;

a releasable fastener for releasably securing the cover free end to the body, and openable to relieve gas pressure generated within said body by the explosive, after the shot contained within the body has been stopped by at least one of the body and cover; and a stop member within the body adjacent the bottom portion thereof covering the bottom of the body and extending at least partly over said sidewalls, for at least one of said significant dissipation of the kinetic energy of the shot and said deflecting of the shot away from the bottom portion; and said bottom portion and said sidewalls cooperating to restrain movement of said stop member when impacted by the shot.

2. The apparatus of claim 1 further comprising means for orienting the firearm within the enclosure so as to direct the barrel thereof and any shot discharged therefrom generally toward the stop member.

3. The apparatus of claim 1 further comprising a liner of ballistic material throughout the interior of the body, with the stop member between the liner and the body.

4. The apparatus of claim 2 wherein said stop member has a concave surface facing the body interior.

5. The bag of claim 4 further comprising energy-absorbing material adjacent the stop member facing the interior of said enclosure.

6. The apparatus of claim 2 wherein said stop member is generally U-shaped with a bight portion of the U overlying a body bottom portion.

7. The apparatus of claim 6 wherein said U-shaped stop member has rounded corners.

8. The apparatus of claim 6 wherein said U-shaped stop member has square corners.

9. The apparatus of claim 2 wherein said stop member is wrapped in ballistic material.

10. The apparatus of claim 1 wherein said stop member is made of steel.

11. The apparatus of claim 2 wherein said stop member is made of ceramic.

12. The apparatus of claim 2 wherein said stop member is made of fiber reinforced epoxy.

13. The apparatus of claim 2 wherein said stop member includes a tube filled with granular material for absorbing the kinetic energy of a shot fired from a firearm within the apparatus bag.

14. The apparatus of claim 1 further comprising an outer liner covering said body and said cover.

15. The apparatus of claim 1 wherein said cover extends from one sidewall and is foldable to cover the opening, and has a free end at least partially overlying the other sidewall.

16. The apparatus of claim 6 wherein said U-shaped stop member has a generally U-shaped cross section.

17. The apparatus of claim 16 wherein the U-shaped cross section has rounded corners.

18. The apparatus of claim 16 wherein the U-shaped cross section has generally square corners.

19. A containment apparatus for the safe recovery and transport of a firearm having a barrel and loaded with a cartridge, the cartridge loaded with a shot and an explosive for projecting the shot through the barrel of the firearm in a preselected direction, the apparatus comprising:

a body of flexible ballistic material forming an enclosure defining an opening through which the firearm is inserted for entry into the body, the body having a pair of sidewalls and a bottom portion generally opposite the opening;

a cover of flexible ballistic material overlying substantially the entire body opening so as to cooperate with the body to completely enclose the firearm and any slot discharged therefrom, the cover having a free end overlying the enclosure;

a releasably fastener for releasably securing the cover free end to the body, and openable to relieve gas pressure generated within said body by the explosive, after the shot container within the body has been stopped by at least one of the body and cover; and a stop member within the body adjacent the bottom portion thereof for at least one of said at least partial dissipation of the kinetic energy of the shot and said deflecting of the shot away from the bottom portion, said stop member including a tube filled with granular material for absorbing the kinetic energy of a shot fired from a firearm within the apparatus bag; and means for orienting the firearm within the enclosure so as to direct the barrel thereof and any shot discharged therefrom generally toward the stop member.

20. The apparatus of claim 19, wherein said tube is made of ballistic material.

* * * * *